US009440427B2

(12) United States Patent
Schmidt

(10) Patent No.: US 9,440,427 B2
(45) Date of Patent: Sep. 13, 2016

(54) DEVICE FOR TWO-SIDED PRINTING

(71) Applicant: HEIDELBERGER DRUCKAMSCHINEN AG, Heidelberg (DE)

(72) Inventor: Thomas Schmidt, Heidelberg (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 6 days.

(21) Appl. No.: 14/808,125

(22) Filed: Jul. 24, 2015

(65) Prior Publication Data

US 2016/0023479 A1 Jan. 28, 2016

(30) Foreign Application Priority Data

Jul. 24, 2014 (DE) ..... 10 2014 010 904

(51) Int. Cl.

| | |
|---|---|
| ***B41F 5/02*** | (2006.01) |
| ***B41F 13/18*** | (2006.01) |
| ***B41F 13/46*** | (2006.01) |
| ***B41J 11/00*** | (2006.01) |
| ***B41J 11/04*** | (2006.01) |
| ***B41F 19/00*** | (2006.01) |
| ***B41F 21/10*** | (2006.01) |

(52) U.S. Cl.

CPC ..... *B41F 13/18* (2013.01); *B41F 5/02* (2013.01); *B41F 13/46* (2013.01); *B41F 19/007* (2013.01); *B41F 21/106* (2013.01); *B41F 21/108* (2013.01); *B41J 11/007* (2013.01); *B41J 11/04* (2013.01)

(58) Field of Classification Search

CPC ..... B41F 31/008; B41F 5/02; B41F 13/18; B41J 3/60; B41J 3/62

See application file for complete search history.

(56) References Cited

U.S. PATENT DOCUMENTS

| | | | | |
|---|---|---|---|---|
| 1,864,192 | A | 6/1932 | Fischer | |
| 8,277,013 | B2 | 10/2012 | Sugahara | |
| 8,292,419 | B2 | 10/2012 | Hori | |
| 8,365,661 | B2 | 2/2013 | Maschler | |
| 2008/0098916 | A1* | 5/2008 | Inoue | B41N 7/00 101/422 |
| 2009/0085998 | A1 | 4/2009 | Kubota et al. | |
| 2010/0095861 | A1* | 4/2010 | Maschler | B41F 7/02 101/409 |
| 2011/0025807 | A1* | 2/2011 | Fukui | B41J 13/226 347/104 |
| 2012/0314013 | A1 | 12/2012 | Takemoto et al. | |
| 2013/0276652 | A1* | 10/2013 | Murakami | B41F 21/104 101/246 |

FOREIGN PATENT DOCUMENTS

| | | | |
|---|---|---|---|
| DE | 563540 | A | 11/1932 |
| DE | 102009043118 | A1 | 4/2010 |
| EP | 2540513 | A1 | 1/2013 |
| JP | 2009083486 | A | 4/2009 |
| JP | 2009285877 | A | 12/2009 |
| JP | 2009297962 | A | 12/2009 |
| JP | 2010058483 | A | 3/2010 |

* cited by examiner

*Primary Examiner* — Kristal Feggins
*Assistant Examiner* — Kendrick Liu
(74) *Attorney, Agent, or Firm* — Laurence A. Greenberg; Werner H. Stemer; Ralph E. Locher

(57) ABSTRACT

A device for two-sided printing of sheet-shaped printing substrates includes an impression cylinder on which the printing substrate is guided through more than 360°. As a result of being guided through more than 360°, the second side of the sheet is moved into an effective region of an ink application unit that has already printed a first side of the printing substrate as it was guided on an upstream impression cylinder.

11 Claims, 7 Drawing Sheets

DEVICE FOR TWO-SIDED PRINTING

CROSS-REFERENCE TO RELATED APPLICATION

This application claims the priority, under 35 U.S.C. §119, of German Patent Application DE 10 2014 010 904.6, filed Jul. 24, 2014; the prior application is herewith incorporated by reference in its entirety.

BACKGROUND OF THE INVENTION

Field of the Invention

The invention relates to a device for two-sided printing of sheet-shaped printing substrates, in which the printing substrate is guided through more than 360° on an impression cylinder.

It is known to print on two sides of sheet-shaped printing substrates. The desired outcome of a sheet that has been printed on both sides is attained, for instance, by passing the sheet through the printing press once to print a complete image on the first or front side of the sheet in one run. Subsequently, the sheet is manually or automatically turned or reversed outside the printing press and re-fed to the printing press to receive a printed image on the second or back side. Due to the reversing of the sheet, difficulties may arise with respect to feeding the sheets to the printing press so that they are in register. Moreover, the reversing of the sheets and the refeeding of the sheets to the printing device are two additional process steps. Other methods propose to print on two sides of the sheets without any external reversing of the sheets. However, those methods require additional printing units to be provided in the printing press especially for printing on the second side of the sheets and an internal reversing device, resulting in additional costs.

German Patent Application DE 563 540, corresponding to U.S. Pat. No. 1,864,192, discloses a rotary printing press including a drying cylinder that guides a sheet through more than 360°. The sheet is initially received by an impression cylinder and the first side is printed in a first printing unit. Then the sheet is transferred from the first impression cylinder to a second impression cylinder, which in turn transfers the sheet to a drying cylinder. The drying cylinder carries out one complete revolution with the sheet and transfers the sheet back to the second impression cylinder where the sheet is printed by a second printing unit. The sheet is likewise guided through more than 360° on the second cylinder.

European Patent Application EP 254 05 13 A1, corresponding to U.S. Patent Application Publication No. US 2012/0314013 A1, discloses a duplex printing press capable of printing the first and second sides of a sheet without the use of a reversing device. The sheet is initially printed on the first side by a first printing unit while it is guided by a first impression cylinder. Then the sheet is transferred to a second impression cylinder on which the second side is printed by a second printing unit.

German Patent Application DE 10 2009 043 118 A1, corresponding to U.S. Pat. No. 8,365,661 B2, discloses a machine for printing on both sides of sheets. In the printing press, the sheets to be printed are individually guided one after another on sheet-guiding cylinders along an advance and return path. The advance path and the return path intersect. The alignment of the path may be horizontal or vertical. Due to the fact that the paths intersect, the sheets need to be spaced apart by a minimum of a sheet length as they are being conveyed on the sheet-guiding cylinders. Since every sheet passes every sheet-guiding cylinder twice, every sheet is guided on every sheet-guiding cylinder through precisely 360°. On the advance path, the sheet is printed on a first side and on the return path, the sheet is printed on a second side. Thus, on every sheet-guiding cylinder, every sheet passes only once through the effective region of a printing region for printing on the first or second side.

SUMMARY OF THE INVENTION

It is accordingly an object of the invention to provide an improved, cost-efficient device for two-sided printing of sheet-shaped printing substrates, which overcomes the hereinafore-mentioned disadvantages of the heretofore-known devices of this general type.

With the foregoing and other objects in view there is provided, in accordance with the invention, a device for two-sided printing of sheet-shaped printing substrates, in which the printing substrate is guided through more than 360° on an impression cylinder, and with its second or back side, the printing substrate is again moved into an effective region of an ink application unit that has already printed the first or front side of the printing substrate on an upstream impression cylinder.

The device of the invention for printing on both sides of sheet-shaped printing substrates is used in duplex printing presses. A sheet-shaped printing substrate is received by a first impression cylinder and is printed on its first side by an ink application unit. Then the printing substrate is transferred from the first impression cylinder to a neighboring second impression cylinder in such a way that the second side faces outward on the second cylinder. The second impression cylinder again guides the sheet through a 360° revolution back into the effective region of the same ink application unit that has already printed the first side. Then the second side is printed on by the same ink application unit.

In accordance with an advantageous first embodiment of the invention, a provision is made for the grippers of the impression cylinder that guides the sheets through more than 360° to be lowered as compared to the grippers of conventional impression cylinders. This is done to avoid the danger of collisions between the closed grippers of the cylinder guiding the sheets through more than 360° and the open grippers of neighboring cylinders.

In accordance with an advantageous further embodiment of the device of the invention, a provision is made for the grippers of the cylinder guiding the sheets through more than 360° and the grippers of its neighboring cylinders to be provided with cams that may be pivoted in and out. This allows the opening and closing instants of the grippers to be accurately adjusted (as needed).

In accordance with another further development of the invention, the impression cylinder that guides the sheets through more than 360° is equipped with a suction unit to attract the sheet on the surface of the cylinder by suction. This causes the sheet to be as close to the cylinder as possible as it is being guided and prevents the sheet from coming into contact with grippers of neighboring cylinders as it is guided past the latter.

In accordance with another further development of the device of the invention, a provision is made for the surface of the cylinder that guides the sheets through more than 360° to have an ink-repellent coating. This is an advantageous aspect because the freshly printed first side of the sheet rests on the surface of the cylinder that guides the sheet through more than 360°. In this way, undesired ink splitting effects and contamination of the cylinder are avoided.

In accordance with a particularly advantageous embodiment of the invention, the ink application unit may be pivoted between the two impression cylinders. This increases the effective region of the ink application unit without increasing the dimensions of the ink application unit. The ink application unit may thus act on various impression cylinders (or rather on the sheets resting thereon) and a second unit is advantageously not required.

In accordance with a further embodiment of the device of the invention, a provision is made for the pivotable ink application unit to be an inkjet print head.

In accordance with another embodiment of the device of the invention, the pivotable ink application unit is a transfer belt that is disposed above the two impression cylinders and is guided by at least three rollers. The upper two rollers are preferably stationary. The at least one lower roller is preferably movable and may be pivoted to bring the transfer belt into contact with the first or second impression cylinder.

In accordance with a concomitant embodiment of the invention, a provision is made for the pivotable ink application unit to be formed of a print head, an imaging cylinder, a first transfer cylinder, and a second transfer cylinder. The print head prints on the imaging cylinder. This imaging cylinder transfers the first-side image to a first transfer cylinder. The first transfer cylinder prints the first-side image on the first side of the sheet while the imaging cylinder applies the second-side image to the second transfer cylinder. This second transfer cylinder is constructed to be capable of being pivoted between the imaging cylinder and the cylinder that guides the sheets through more than 360°. The second transfer cylinder transfers the second-side image to the second side of the sheet.

Other features which are considered as characteristic for the invention are set forth in the appended claims.

Although the invention is illustrated and described herein as embodied in a device for two-sided printing, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Figure 1A:
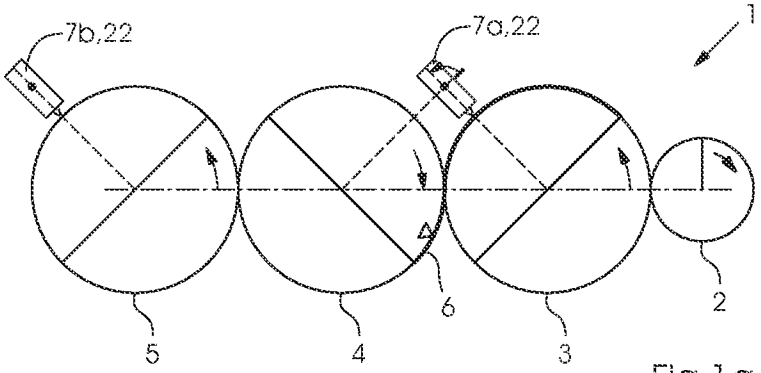
FIGS. 1A, 1B, 2A, 2B, 3A and 3B are diagrammatic, side-elevational views of preferred embodiments of the invention.

Referring now to the figures of the drawings in detail and first, particularly, to FIG. 1A thereof, there is seen a section of a printing press 1. The section is formed of a feed cylinder 2 and at least two impression cylinders 3, 4, 5. The second impression cylinder 4 is a cylinder that guides the sheets through more than 360°. The section further includes two print heads 7*a*, 7*b* embodied as inkjet print heads in which a first inkjet print head 7*a* may be pivoted between the first impression cylinder 3 and the second impression cylinder 4. Furthermore a sheet 6 is shown as it passes through the printing process. The front or first side of the sheet 6 is printed on the first impression cylinder 3 by the first inkjet head 7*a* and then the sheet 6 is transferred to the second impression cylinder 4. The printed first side of the sheet 6 faces inward on the second impression cylinder 4.

Figure 1B:
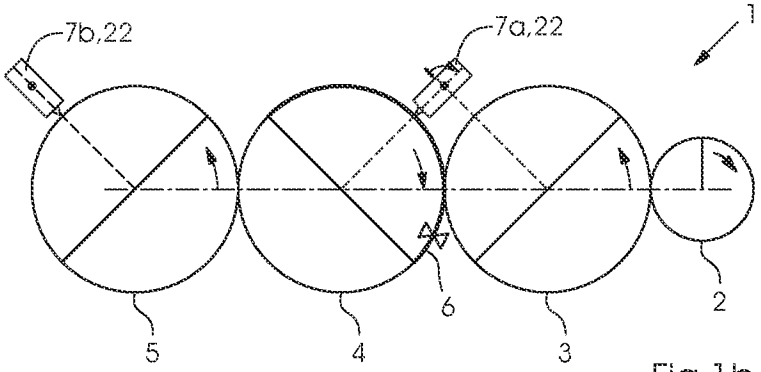

FIG. 1B illustrates the same section of the printing press 1 shown in FIG. 1A. In FIG. 1B, the second impression cylinder 4 carrying the sheet 6 has already carried out a revolution through more than 360°. The first inkjet head 7*a* has been pivoted in the direction of the second impression cylinder 4 to print on the second or back side of the sheet 6.

Figure 2A:
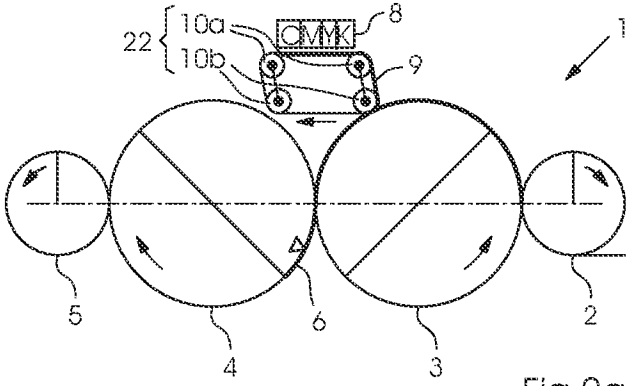

FIG. 2A illustrates a section of a printing press 1 formed of a feed cylinder 2 and at least two impression cylinders 3 and 4 as well as one or more optional further cylinders 5. The second impression cylinder 4 is a cylinder that guides the sheets through more than 360°. The section further shows an ink application unit 22 formed of a print head 8 and an endless ink transfer belt 9 guided by four rollers 10*a*, 10*b*. The lower two rollers 10*b* are pivotable in such a way that they bring the ink transfer belt 9 into contact either with a sheet 6 on the first impression cylinder 3 or with a sheet 6 on the second impression cylinder 4. The ink transfer belt 9 is shown in a position for printing on a sheet 6 located on the first impression cylinder 3. A sheet 6 is shown as it passes through the printing process. The transfer belt 9 prints the first side of the sheet 6 as it is guided on the first impression cylinder 3. Then the sheet 6 is transferred to the second impression cylinder 4. The first side of the sheet 6, which has already been printed, faces inward on the second impression cylinder 4.

Figure 2B:
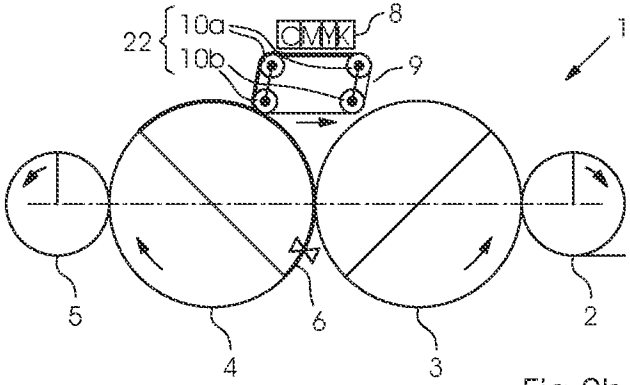

FIG. 2B illustrates the same section of the printing press 1 shown in FIG. 2A. The second impression cylinder 4 carrying the sheet 6 has already carried out a revolution through more than 360°. The two lower rollers 10*b* of the ink application unit 22 have been pivoted in the direction of the second impression cylinder 4. The transfer belt 9 now prints the second side of the sheet 6. The direction of rotation of the belt 9 has been reversed.

Figure 3A:
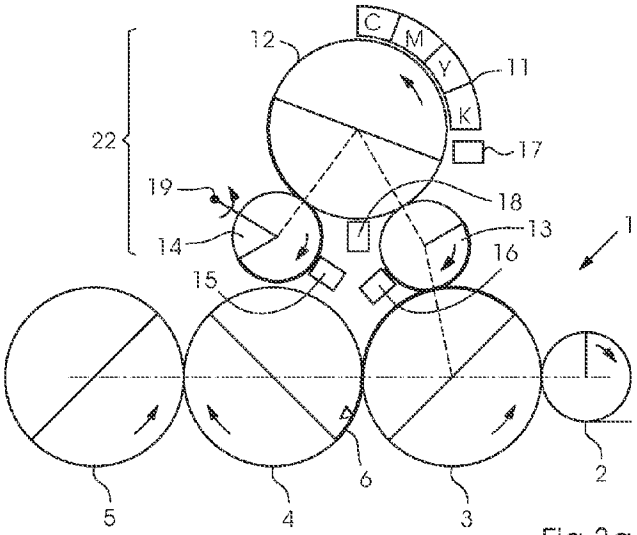

FIG. 3A illustrates a section of a printing press 1 formed of a feed cylinder 2, at least two impression cylinders 3 and 4, and one or more optional further cylinders 5. The second impression cylinder 4 is embodied as a cylinder that guides the sheets 6 through more than 360°. The section further shows an ink application unit 22 formed of a print head 11, an imaging cylinder 12, a first transfer cylinder 13 with a washing device 16, a second transfer cylinder 14 with a washing device 15 as well as two washing devices 17, 18 associated with the imaging cylinder 12. The second transfer cylinder 14 is constructed in such a way that it may be pivoted between the imaging cylinder 12 and the second impression cylinder 4. In addition, the second transfer cylinder 14 is capable of changing its direction or rotation as a function of whether it rolls on the imaging cylinder 12 or on the second impression cylinder 14. The figure further shows a sheet 6 that passes through the printing process. The transfer cylinder 13 prints the first side of the sheet 6 as it is conveyed on the first impression cylinder 3. Then the sheet 6 is transferred to the second impression cylinder 4. The printed first side of the sheet 6 faces inward on the second impression cylinder 4. During this process, the imaging cylinder 12 transfers the second-side image onto the second transfer cylinder 14 that has been pivoted in its direction.

Figure 3B:
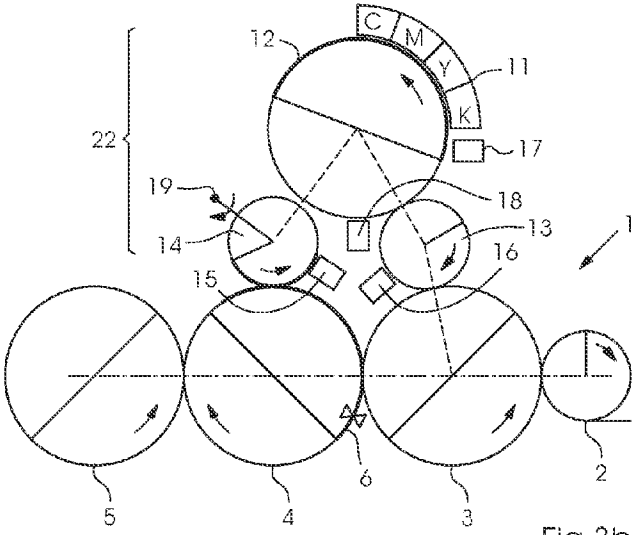

FIG. 3B illustrates the same section of the printing press 1 shown in FIG. 3A. The second impression cylinder 4 carrying the sheet 6 has already carried out a revolution through more than 360°. The second transfer cylinder 14 has been pivoted in the direction of the second impression cylinder 4. The second transfer cylinder 14 now prints on the second side of the sheet 6.

Figure 4A:
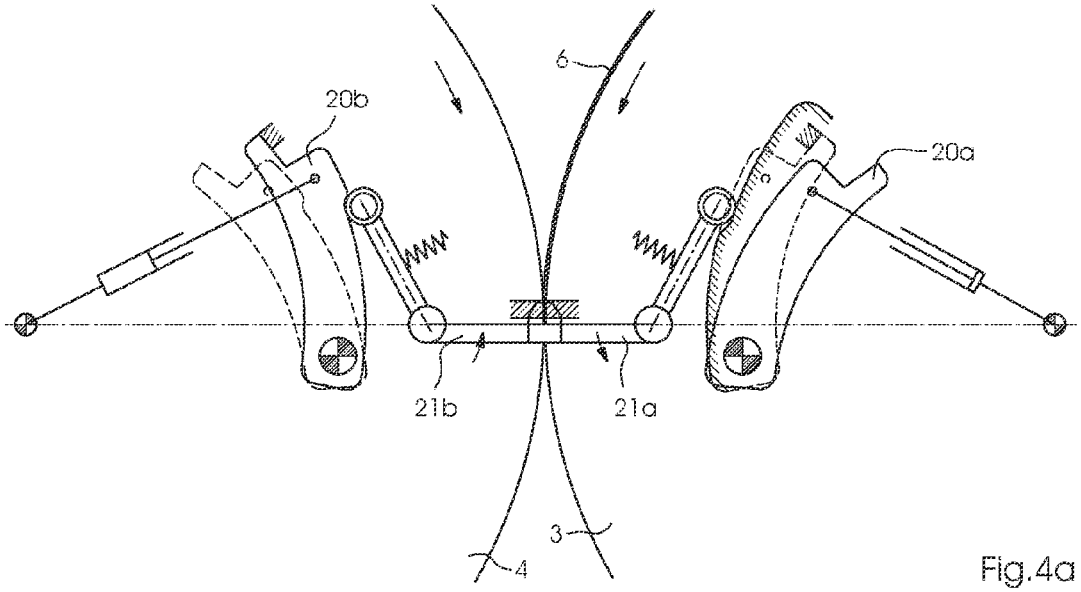
FIGS. 4A, 4B, 4C and 4D are diagrammatic, side-elevational views of a preferred gripper mechanism of the invention.

FIG. 4A illustrates a section of a printing press 1 shown in FIGS. 1A-3B. The figure shows the instant in which the sheet 6 is transferred from the first impression cylinder 3 to the second impression cylinder 4. At the right, the first impression cylinder 3 is shown with a selectively activatable cam 20*a* pivoted in and with an open gripper 21*a*. The sheet 6 rests on the first impression cylinder 3. At the left, the second impression cylinder 4 which is shown likewise includes a selectively activatable cam 20*b* and a gripper 21*b*. The gripper 21*b* takes over the sheet 6 from the gripper 21*a*.

Figure 4B:
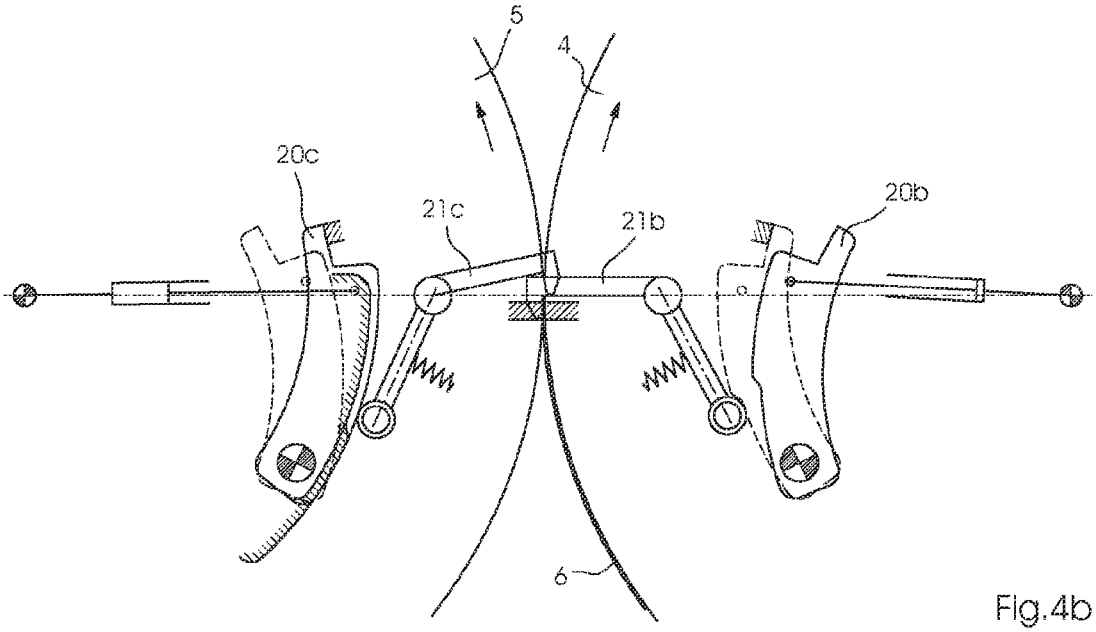

FIG. 4B illustrates a section of a printing press 1 shown in FIGS. 1A-3B. The figure shows the instant in which the second impression cylinder 4 guides the sheet past the third impression cylinder 5 without transferring it. At the right, the second impression cylinder 4 is shown with a selectively activatable cam 20*b* pivoted out and a closed gripper 21*b*. The sheet 6 rests on the second impression cylinder 4. At the left, the third impression cylinder 5 is shown. It includes a selectively activatable cam 20*c* that has been pivoted in and an open gripper 21*a*.

Figure 4C:
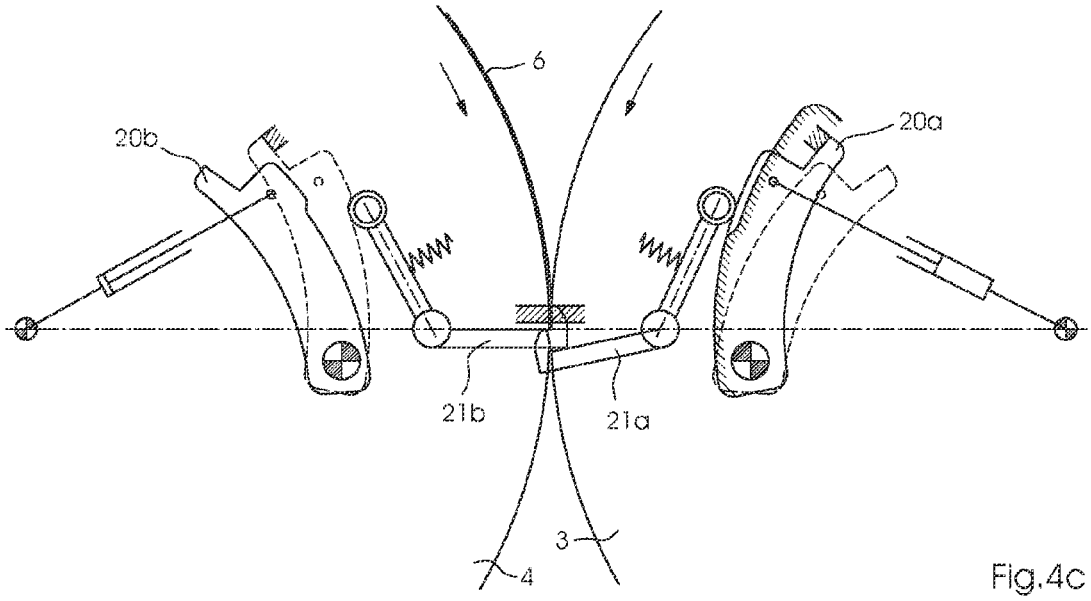

FIG. 4C illustrates a section of a printing press 1 shown in FIGS. 1A-3B. The figure shows the instant at which the second impression cylinder 4 guides the sheet past the first impression cylinder 3 without transferring it. At the right, the first impression cylinder is shown with the selectively activatable cam 20*a* pivoted in and the gripper 21*a* opened. At the left, the second impression cylinder 4 is shown with the selectively activatable cam 20*b* pivoted out and the gripper 21*b* closed. The sheet 6 rests on the second impression cylinder.

Figure 4D:
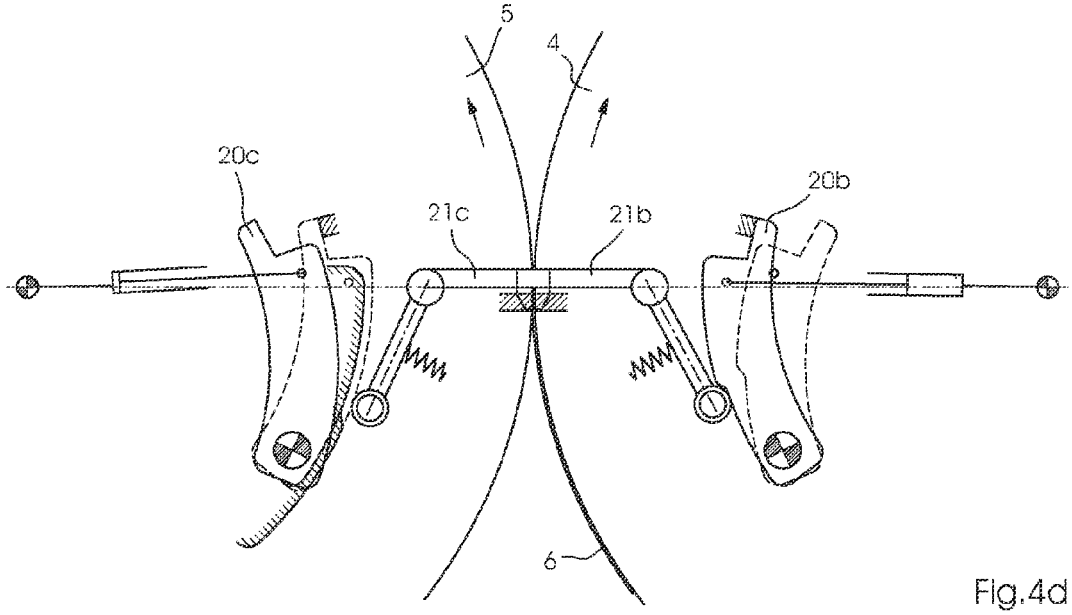

FIG. 4D illustrates a section of a printing press shown in FIGS. 1A-3B. The figure shows the instant in which the second impression cylinder 4 transfers the sheet to the third impression cylinder 5. At the right, the second impression cylinder 4 is shown with the selectively activatable cam 20*b* pivoted in and the open gripper 21*b*. The sheet 6 is still on the second impression cylinder 4. At the left, the third impression cylinder 5 is shown with a selectively activatable cam 20*c* pivoted out and the closed gripper 21*c*. The gripper 21*c* takes the sheet 6 from the gripper 21*b*.

FIG. 1A and FIG. 1B illustrate an embodiment of the invention which includes pivotable inkjet print heads 7, 7*a*. A sheet 6 is transferred from a feed cylinder 2 to a first impression cylinder 3. On the first impression cylinder 3, the first side of the sheet 6 is printed by the first inkjet print head 7. The first impression cylinder 3 transfers the sheet 6 to the second impression cylinder 4, which receives the sheet 6 and guides it past a third impression cylinder 5 without transferring it. At the same time, the inkjet print head 7 pivots through 90° in the direction of the second impression cylinder 4. The second impression cylinder 4 guides the sheet 6 back into the effective region of the first inkjet print head 7, which then prints the second side of the sheet 6. Subsequently, the second impression cylinder 4 passes the sheet 6 on to the third impression cylinder 5. The inkjet print head 7 returns to the position shown in FIG. 1A to print on the first side of the next sheet.

FIG. 2A and FIG. 2B illustrate an embodiment of the invention which includes an ink application unit 22 that is formed of a multicolor inkjet print head 8 and an endless ink-collecting ink transfer belt 9 guided by four rollers 10*a*, 10*b*. The print head 8 prints the image onto the transfer belt 9. A sheet 6 is transferred from a feed cylinder 2 to a first impression cylinder 3. The two lower rollers 10*b* have been pivoted in the direction of the first impression cylinder 3 and bring the transfer belt 9 into contact with the sheet 6. The transfer belt 9 prints the image onto the first side of the sheet 6. The sheet 6 is transferred from the first impression cylinder 3 to the second impression cylinder 4, which receives the sheet 6 and guides it past a third impression cylinder 5 without transferring it. At the same time, the two lower rollers 10*b* pivot in the direction of the second impression cylinder 4. The printing direction of the belt 9 is reversed. The second impression cylinder 4 guides the sheet 6 back into the effective region of the transfer belt 9, which now prints the second side of the sheet 6. Then the second impression cylinder 4 transfers the sheet 6 to the third impression cylinder 5. The belt 9 pivots back into the position shown in FIG. 2A to print the first side of the next sheet.

FIG. 3A and FIG. 3B illustrate an embodiment of the invention which includes an ink application unit 22 formed of a multicolor inkjet print head 11, an imaging cylinder 12, a first transfer cylinder 13 with a washing device 16, a second transfer cylinder 14 with a washing device 15, as well as two washing devices 17, 18 associated with the imaging cylinder 12. The print head 11 prints the multicolor first-side image onto the imaging cylinder 12. The imaging cylinder 12 then transfers the image to the first transfer cylinder 13, which transfers the image to the sheet 6. Then potential residues of the first-side image are washed off the imaging cylinder by the washing device 17. At the same time, a sheet 6 is transferred from a feed cylinder 2 to a first impression cylinder 3. The first side of the sheet 6 is printed on the first impression cylinder 3. Subsequently, the first impression cylinder 3 transfers the sheet 6 to the second impression cylinder 4. At the same time, the print head 11 prints the second-side image on the imaging cylinder 12. The second transfer cylinder 14 has been pivoted to the imaging cylinder 12. The imaging cylinder 12 prints the image onto the second transfer cylinder 14. The second impression cylinder guides the sheet 6 past a third impression cylinder 5. At the same time, the second transfer cylinder 14 pivots in the direction of the second impression cylinder 4, where it prints the second-side image onto the second side of the sheet 6. Then the second impression cylinder 4 transfers the sheet 6 to the third impression cylinder 5.

FIG. 4A, FIG. 4B, FIG. 4C and FIG. 4D illustrate the progression of the gripper positions as the sheet is guided through 360° on the second impression cylinder 4. Initially, the sheet is located on the first impression cylinder 3 (FIG. 4A). The selectively activatable cam 20*a* on the first impression cylinder 3 is initially pivoted out and the grippers 21*a* are closed. At this instant, the selectively activatable cam 20*b* on the second impression cylinder 4 is pivoted in and the grippers 21*a* are open. At the instant of transfer, the cam 20*a* of the first impression cylinder 3 is pivoted in, causing the grippers 21*a* to open. At the same time, the cam 20*b* of the second impression cylinder 4 is pivoted out, causing the grippers 21*b* to close and grip the sheet 6. After an approximately 180° revolution, the sheet has reached the point of transfer to the third impression cylinder 5 (FIG. 4B). The cam 20*c* of the third impression cylinder 5 has been pivoted in and the grippers 21*c* are open. The cam 20*b* of the second impression cylinder 4 remains pivoted out and the grippers 21*b* remain closed, causing the sheet 6 to be guided past the third cylinder 5. After a further revolution through approximately 180°, the sheet 6 again reaches the point of transfer from the first impression cylinder 3 to the second impression cylinder 4 (FIG. 4C). Now the cam 20*a* of the first impression cylinder has been pivoted in, the grippers 21*a* are open, and the sheet 6 is also guided past the first impression cylinder 3. After a further revolution through approximately 180°, the sheet 6 again reaches the point of transfer to the third impression cylinder 5 (FIG. 4D). Now the cam 20*c* of the third impression cylinder 5 is pivoted out, causing the grippers 21*c* to close and grip the sheet 6. Meanwhile the cam 20*b* of the second impression cylinder 4 is pivoted in, causing the grippers 21*b* to open. Thus the sheet 6 is guided through more than 360° on the second impression cylinder 4 and is subsequently transferred to the third impression cylinder 5.

The invention claimed is:

1. A device for two-sided printing of sheet-shaped printing substrates, the device comprising:

a first upstream impression cylinder, a second impression cylinder adjacent said first upstream impression cylinder and a third impression cylinder adjacent said second impression cylinder;

an ink application unit having an effective region, said ink application unit initially printing a first side of the printing substrate on said first upstream impression cylinder in said effective region; and said second impression cylinder carrying the printing substrate thereon through more than a 360° revolution and thereby guiding the printing substrate past said third impression cylinder without transferring the printing substrate to said third impression cylinder and said second impression cylinder moving a second side of the printing substrate once again into said effective region of said ink application unit.

2. The device according to claim 1, wherein said second impression cylinder guiding the printing substrate through more than 360° has grippers configured to be lowered.

3. The device according to claim 1, wherein said second impression cylinder guiding the printing substrate through more than 360° has cams being pivotable in and out.

4. The device according to claim 1, wherein said second impression cylinder guiding the printing substrate through more than 360° attracts the sheet-shaped printing substrate by suction.

5. The device according to claim 1, wherein said second impression cylinder guiding the printing substrate through more than 360° has a surface and an ink-repellent coating on said surface.

6. The device according to claim 1, wherein said first and second impression cylinders are disposed in succession, and said ink application unit is pivotable between said first and second impression cylinders.

7. The device according to claim 6, wherein said pivotable ink application unit is an inkjet print head.

8. The device according to claim 6, wherein said pivotable ink application unit is a transfer belt disposed above said first and second impression cylinders and guided by at least three rollers including an upper two rollers being stationary and at least one lower roller being movable.

9. The device according to claim 6, wherein:

said pivotable ink application unit is formed of a print head, an imaging cylinder, a first transfer cylinder and a second transfer cylinder;

said print head prints on said imaging cylinder;

said imaging cylinder prints a first-side image onto said first transfer cylinder;

said first transfer cylinder transfers the first-side image to the first side of the printing substrate;

said imaging cylinder transfers a second-side image onto said second transfer cylinder;

said second transfer cylinder is pivotable between said imaging cylinder and said second impression cylinder guiding the printing substrates through more than 360°; and said second transfer cylinder transfers the second-side image onto the second side of the printing substrate.

10. The device according to claim 1, wherein said ink application unit prints the second side of the printing substrate on said second impression cylinder guiding the printing substrate through more than 360°.

11. A method for two-sided printing of sheet-shaped printing substrates, the method comprising the following steps:

providing a first upstream impression cylinder, a second downstream impression cylinder adjacent the first upstream impression cylinder, a third impression cylinder adjacent the second downstream impression cylinder and an ink application unit having an effective region;

initially printing a first side of the printing substrate on said first upstream impression cylinder in said effective region of said ink application unit;

then carrying the printing substrate on said second downstream impression cylinder through more than a 360° revolution and thereby guiding the printing substrate past the third impression cylinder without transferring the printing substrate to the third impression cylinder and moving a second side of the printing substrate once again into said effective region of said ink application unit; and then printing the second side of the printing substrate on said second downstream impression cylinder in said effective region of said ink application unit.

* * * * *